United States Patent [19]

Kendall

[11] Patent Number: 4,628,797

[45] Date of Patent: Dec. 16, 1986

[54] ROTARY ACTUATOR

[75] Inventor: Giles A. Kendall, Burbank, Calif.

[73] Assignee: Menasco Inc, Burbank, Calif.

[21] Appl. No.: 512,101

[22] Filed: Jul. 7, 1983

[51] Int. Cl.[4] ..... F01C 9/00

[52] U.S. Cl. ..... 92/120; 92/255

[58] Field of Search ..... 92/120, 167, 84, 129, 92/191, 215, 256, 255

[56] References Cited

U.S. PATENT DOCUMENTS

| | | | |
|---|---|---|---|
| 2,436,908 | 3/1948 | Van Weenan et al. | 92/84 X |
| 2,649,077 | 8/1953 | Mehm | 92/120 |
| 3,173,344 | 3/1965 | Mongitore | 92/120 |
| 3,444,788 | 5/1969 | Sneen | 92/120 |
| 3,446,120 | 5/1969 | Sneen | 92/120 |
| 3,995,536 | 12/1976 | Tenfjord | 92/120 |

*Primary Examiner*—Robert E. Garrett

*Assistant Examiner*—Mark A. Williamson

*Attorney, Agent, or Firm*—Robert W. Dickerson; Richard A. Dornon

[57] ABSTRACT

A rotary actuator having a cylindrical housing in which an annular piston arm rotates through an arc within an annular chamber in the housing as a result of fluid pressure to produce rotary motion communicated from the piston to the drive shaft. The piston head is capable of lateral or radial movement relative to the piston arm so as to accommodate flexing of the piston arm or variances in the shape of the chamber. Friction reduction washers are placed between the piston head and the piston arm to facilitate this movement. The overall effect is to reduce the friction encountered by the piston head against the walls of the chamber during movement, thereby improving overall performance of the actuator.

14 Claims, 6 Drawing Figures

ROTARY ACTUATOR

BACKGROUND OF THE INVENTION

1. Field of Invention

The invention hereinafter described and claimed pertains to actuators which are used to convert fluid pressure to mechanical movement. More particularly, this invention pertains to such actuators which produce rotary motion by means of an annular piston or pistons.

2. Prior Art

Rotary actuators are used to open and close doors or windows, raise and lower flaps on an airplane wing, turn switches or operate valves and any other device which must be moved in rotary fashion about a center point. Such actuators are generally fluid driven, meaning that a fluid, typically hydraulic or pneumatic, is used to cause the rotary movement.

One mechanism used to obtain this rotary movement utilizes one or more annular pistons. This is old in the art. For example, U.S. Pat. No. 163,186, issued May 11, 1875, discloses an oscillating engine in which a pair of opposing annular pistons are utilized to generate motion. A similar arrangement of oscillating dual annular pistons is more recently disclosed in U.S. Pat. No. 3,446,120, issued Nov. 14, 1966, in an oscillating fluid-driven actuator.

Methods other than the annular piston arrangement have been used in the past to produce this rotary motion. A straight piston mechanism, in which the linear movement of the piston moves a rack gear across a gear shaft, imparting rotary motion to the gear shaft, has been used. The annular piston arrangement, however, produces greater torque and is more compact and light weight.

Actuators may be single acting or double acting. In a single acting actuator, motion is produced in one direction only. For example, in a single piston mechanism, the piston is caused to travel in the piston chamber by the input of fluid pressure medium into the chamber. Once the pressure is released, the piston will be returned to its starting position, usually by the gravitational weight of the device which was originally moved by the piston or by a spring. In a double acting actuator, rotary motion is produced in both the counterclockwise and clockwise directions. This is shown, for example, in U.S. Pat. No. 3,446,120, in which opposing annular segment shaped pistons, working in similarly opposing piston chambers, can be made to move in opposing directions by the oscillation of pressure to the opposing chambers. Obviously, there are many uses for an actuator where the double acting feature will be preferred, if not required.

The prior art rotary actuators have suffered from a number of drawbacks. The first drawback arises as a result of the difficulty in providing for a sufficiently durable seal between the piston head and the annular chamber. Because of the variances in the dimensions of the annular chamber which can arise during manufacture, difficulty was encountered in designing a piston head which would provide a sufficiently durable seal against the walls of the annular chamber during operation, without creating excessive friction between the piston head and the wall. From a design standpoint it is the ultimate goal to produce the maximum torque from the rotary actuator for a given chamber pressure. It will be easily understood that any excess friction between the piston head and the walls of the annular chamber will greatly reduce the resultant torque from a given chamber pressure.

A further drawback encountered with the annular piston arrangement was that under any substantial pressure, the annular piston arm will undergo some flexing as the direction of the force exerted on the piston arm by the fluid pressure against the piston head is linear and is tangential to the axis of the piston arm. Any slight flexing of the piston arm would cause increased friction between the piston head and the wall of the annular chamber thereby reducing performance of the actuator.

One method which has been utilized to attempt to neutralize this friction buildup resulting from deformations of the chamber wall and of the piston arm is to allow the piston head to "float" relative to the piston arm. This is shown, for example, in Sneen, U.S. Pat. No. 3,446,120 (see FIG. 11 of U.S. Pat. No. 3,446,120) and in Mehm, U.S. Pat. No. 2,649,077 (see FIG. 2 of U.S. Pat. No. 2,649,077). This method aided in the reduction of friction, but there was still considerable friction generated in these devices by the friction of the piston head against the piston arm. In other words, when the piston head is under substantial pressure, it is forced, under that great pressure, against the piston arm. Accordingly, there will be great friction between the piston head and the piston arm should the piston head attempt to move laterally relative to the piston arm. Therefore, the fact that the piston head is designed to "float" in the prior art devices does not improve the performance of the actuator as well as it might because the friction between the piston head and the piston arm will tend to hold the piston head against the chamber wall with greater force, thereby producing unnecessary friction between the piston head and the chamber wall.

Another method used to reduce sidewall friction has been the installation of slide pads of antifriction material on the exterior side of the piston arm which abuts the chamber wall. See Sneen, U.S. Pat. No. 3,444,788, issued May 20, 1969. This method also does not address the problem of piston head/piston arm friction.

Another drawback inherent in the prior art devices resulted from the cumbersome and often complex design and relationship of the component parts resulting in higher costs of manufacture and maintenance and lower performance.

SUMMARY OF INVENTION

The rotary actuator herein described and claimed overcomes the drawbacks of the prior art in an actuator which utilizes only one annular chamber integrally formed in a housing and a piston operating in that single annular chamber, and which provides friction reduction means between the piston head and piston arm to improve performance.

A novel design for the actuator provides a single annular chamber formed integrally within a cylindrical cavity in the housing. A single piston head, attached to a single arm, is caused to travel in the annular chamber, in both directions, by providing for the pressurization of the larger cavity in which the piston arm resides, and allowing that pressure to act on the underside of the piston head to drive the piston into the annular chamber, and providing the conventional pressurizing means to pressurize the annular chamber ahead of the piston head to force the piston arm out of the annular chamber, thereby providing for the oscillating or double-acting rotary motion required for most applications of the actuator in a very simple, inexpensively manufactured embodiment.

Additionally, friction reduction means are provided between the piston head and the piston arm to allow for freer movement of the piston head relative to the piston arm, so that the piston head may float within the annular chamber, thereby allowing the piston head to accommodate any flexing of the piston arm under load and any variances in the dimensions of the annular chamber.

Accordingly, it is the object of this invention to provide a simplified rotary actuator, which actuator has improved performance characteristics.

Other and further objects of this invention will be apparent to those skilled in the art upon a review of the attached figures and the following description of the preferred embodiment.

DESCRIPTION OF THE PREFERRED EMBODIMENT

Figure 1:
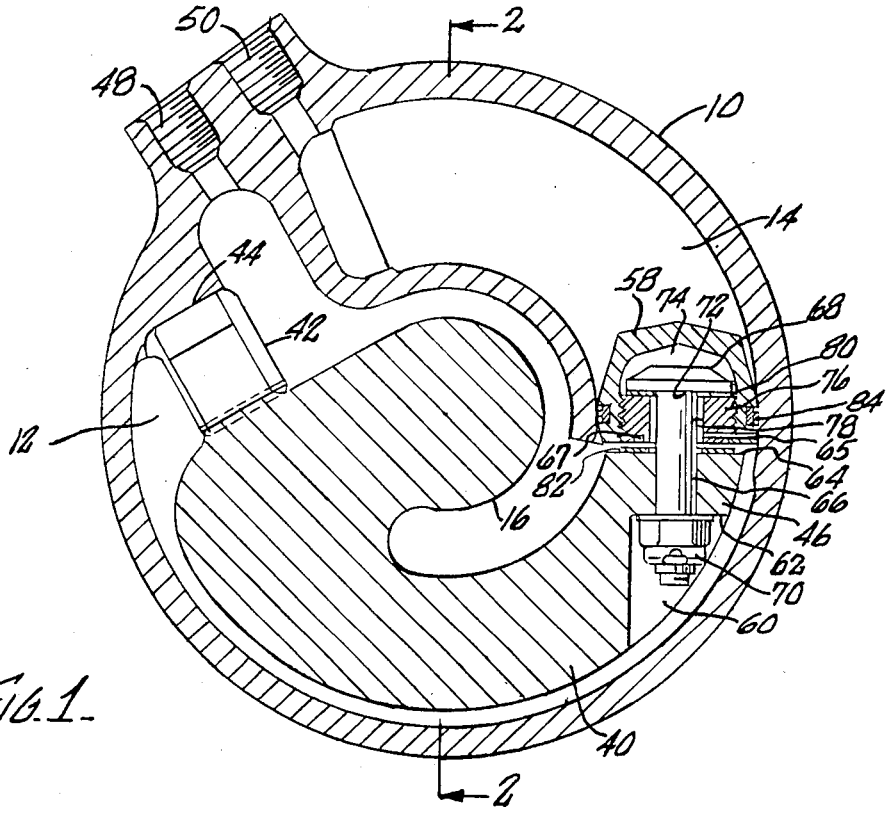
FIG. 1 is a top view of the actuator of this invention, in cross-section taken along line 1—1 in FIG. 2. This figure shows the annular chamber and the single piston which operates therein, and the larger chamber in the cylindrical housing in which the piston arm resides. Also shown in this figure is the friction reduction means between the piston head and the piston arm.
Figure 2:
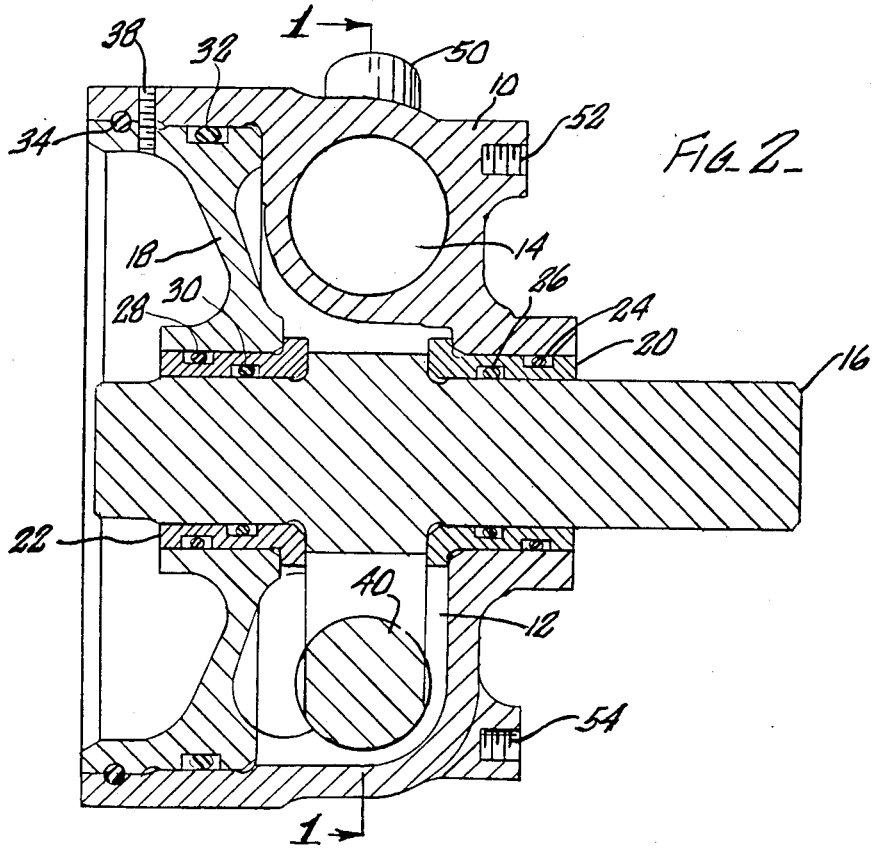
FIG. 2 is a side view of the actuator of this invention in cross-section taken along line 2—2 in FIG. 1. The relationship between the central drive shaft, the annular piston and the annular chamber is shown. Also shown is the general construction of the actuator.
Figure 3:
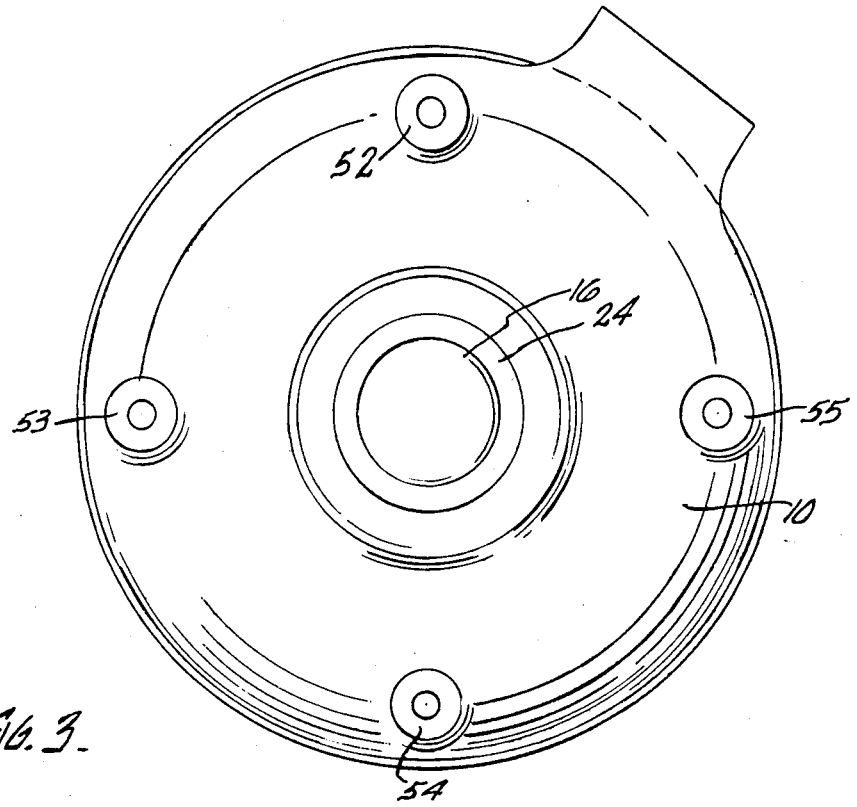
FIG. 3 is a bottom view of the actuator.
Figure 4:
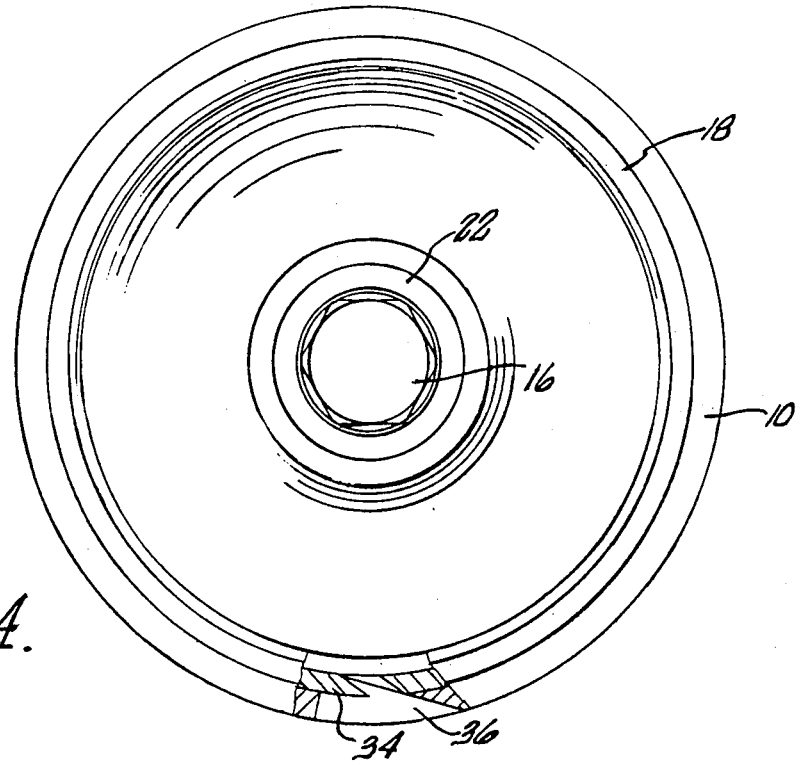
FIG. 4 is a top view of the actuator.

The actuator of this invention has an outer housing 10. In the preferred embodiment, the housing 10 is of a circular configuration for greater compactness. The housing 10 is constructed from steel. The interior of housing 10 is a hollow cylinder containing a first chamber 12 and a second chamber 14. The second chamber 14 is annular in configuration and in the preferred embodiment is in the shape of a toroid arc segment. To obtain greater precision, thereby reducing dimensional tolerances in the second chamber 14, the toroid segment is preferably cut, rather than cast.

The housing 10 has a small opening at one end through which is inserted drive shaft 16. The other end of body 10 is open. A cap 18, having a central opening to fit over the end of drive shaft 16, fits into the housing 10 to enclose chamber 12.

It will be appreciated that housing 10 is generally a cylinder, closed at one end, and open at the other. Annular chamber 14 is formed at the bottom edge of the closed end of this cylinder. The remaining volume of the cylinder is open, defining a void space. This large void space becomes first chamber 12 after cap 18 is inserted, but provides important advantages relating to the construction of the actuator. For example, it will be appreciated that this configuration allows the piston arm 40 and the drive shaft 16 to be of unitized construction, rather than the splined attachment means typically utilized between the piston and drive shaft in other actuators.

Thrust bearings 20 and 22 fit around the drive shaft 16 and in the apertures in the housing 10 and cap 18, respectively, to hold the drive shaft 16 in place and to allow the drive shaft 16 to rotate. Two sets of packing and retainer rings 24 and 26 seal thrust bearing 20 against housing 10 and drive shaft 16 respectively; and two sets of packing and retainer rings 28 and 30 provide the same function between thrust bearing 22 and cap 18 and drive shaft 16. Another packing and retainer ring set 32 seals the exterior circumference of the cap 18 against housing 10. A metal split ring 34 is inserted into an appropriately sized aperture formed by corresponding grooves in housing 10 and cap 18 to hold cap 18 in place against housing 10. An access slot 36 is provided in the exterior of housing 10 to allow the split ring 34 to be fed into position. A set screw 38 keeps the cap 18 from turning in place relative to the housing 10.

Looking at FIG. 1, it will be seen that piston arm 40 is formed integrally with drive shaft 16 as they are of unitized construction. It will be understood that conventional attachment means could be used. It also will be appreciated that the first chamber 12 is of sufficient size to accommodate therein the piston arm 40 and a portion of the drive shaft 16.

On the heel of piston arm 40 is attached a rubber stop 42. A shoulder 44 is formed on the interior of housing 10 against which rubber stop 42 abuts to stop movement of the piston arm 40.

Piston arm 40 is also formed as an arc segment of a toroid having an arc radius equal to that of second chamber 14. The cross-sectional diameter of piston arm 40 is appreciably less than the interior cross-sectional diameter of second chamber 14 so that piston arm 40 may move freely into second chamber 14. It will be appreciated that in order for piston arm 40 to be able to move completely into second chamber 14, the center point for the arc radius of piston arm 40 must be the same as the center point for the arc radius for second chamber 14. It will further be appreciated that for improved compactness, when piston arm 40 is in the fully retracted position with rubber stop 42 against shoulder 44, the distal end 46 of piston arm 40 is at or near the entrance to second chamber 14.

Charging ports 48 and 50 provide the means whereby fluid pressure can be introduced into first chamber 12 and second chamber 14, respectively. Threaded holes 52, 53, 54 and 55 are provided in the exterior portion of body 10 for ease of attachment of the actuator to another surface.

Piston head 58 is attached to piston arm 40 by means which allow the piston head 58 to "float" in a lateral, or in the preferred embodiment, a radial manner relative to piston arm 40. These attachment means comprise a corner notch 60 formed in piston arm 40 which presents a shoulder 62 which is parallel to the face 64 of the piston arm 40. A hole is formed between the face 64 and shoulder 62. The hole is situated at the center point of face 64. A bolt 66 having an enlarged head 68 extends through that hole and is secured by nut 70 against shoulder 62. The length of bolt 66 is such that it extends an appreciable distance beyond the face 64 of piston arm 40. The enlarged head 68 of bolt 66 presents a shoulder 72 which is parallel to face 64.

The piston head 58, which is preferrably constructed of an aluminum-nickel-bronze alloy, is cup-shaped such that it has an interior cavity 74 of sufficient size to fit over the enlarged head 68 of bolt 66. A portion of the interior surface of cavity 74 is threaded so as to receive threaded insert 76 which retains the piston head 58 upon enlarged head 68 of bolt 66. It will be appreciated that the hole in piston arm 40 between shoulder 62 and face 64 has an interior diameter equal to the exterior diameter of bolt 66 such that there is no lateral or radial movement by bolt 66 in that hole. On the other hand, the interior diameter of hole 78 in threaded insert 76 is appreciably larger than the exterior diameter of bolt 66. Similarly, the interior diameter of cavity 74 is appreciably larger than the exterior diameter of enlarged head 68. Accordingly, piston head 58 is capable of lateral or radial movement relative to bolt 66 and hence, relative to piston arm 40. It will further be appreciated that to provide for this lateral or radial movement, there must be some free space provided between piston head 58 and piston arm 40. This free space is obtained by making the interior cavity 74 and piston head 58 appreciably deeper than the distance bolt 66 extends away from face 64 of piston arm 40. A lock pin 65 is inserted into corresponding holes in piston head 58 and insert 76 to prevent insert 76 from turning after it has been inserted. Wrenching hole 67 is added to insert 76 to aid in its insertion and removal.

Even though these provisions have been made to allow for radial or lateral movement of piston head 58 relative to piston arm 40, it will be readily understood after having read the preceding material that if second chamber 14 is subjected to high pressure, a tremendous force will be exerted against piston head 58 pushing it against the face 64 of piston arm 40. The resultant friction between piston head 58 and insert 76 against the face 64 of piston arm 40 will virtually preclude the free lateral movement of piston 58. This completely vitiates the beneficial results expected by allowing piston head 58 to float in the first instance. To counteract this phenomena, a low friction thrust washer 82 is placed between face 64 of piston arm 40 and the threaded insert 76.

Similarly, to prevent the resultant friction during engagement between the insert 76 of piston 58 and the shoulder 72 of the enlarged head 68 (when cavity 12 is subjected to pressure) from interfering with free lateral movement, a low friction thrust washer 80 is placed between shoulder 72 and insert 76. Hence, it will be seen that piston 58 is axially movable relative to arm 40 between a first position (See FIG. 1) in which washer 80 provides friction reduction for lateral movement and a second position, in which washer 82 provides friction reduction for lateral movement. Suitable thrust washers have a coating of a polytetrafluoroethylenelead mixture which provides for exceptionally low friction. Therefore, even under substantial loads, the piston head 58 will be able to float relative to the piston arm 40. Therefore, during the travel of the piston arm 40 through its arc in second chamber 14, as the piston arm 40 may flex during surges in pressure, or as the piston head 58 encounters variances in the configurations of the walls of second chamber 14, the piston head 58 will more readily and with less friction float relative to piston arm 40 so that the piston head 58 will adjust its position to seek the path of least resistance, thereby minimizing friction between it and the walls of second chamber 14, producing maximized performance for the actuator.

In FIG. 1, one of several embodiments for the configuration of the piston head 58 is shown. Here it will be noted that the exterior configuration of piston head 58 is such that it contacts the walls of second chamber 14 at one circumferential point only. At that point, a sealing ring 84 is fitted into an appropriately sized groove formed in piston head 58. The best performance is obtained by using a sealing ring 84 which is resistant to extrusion under high pressure.

Figure 5:
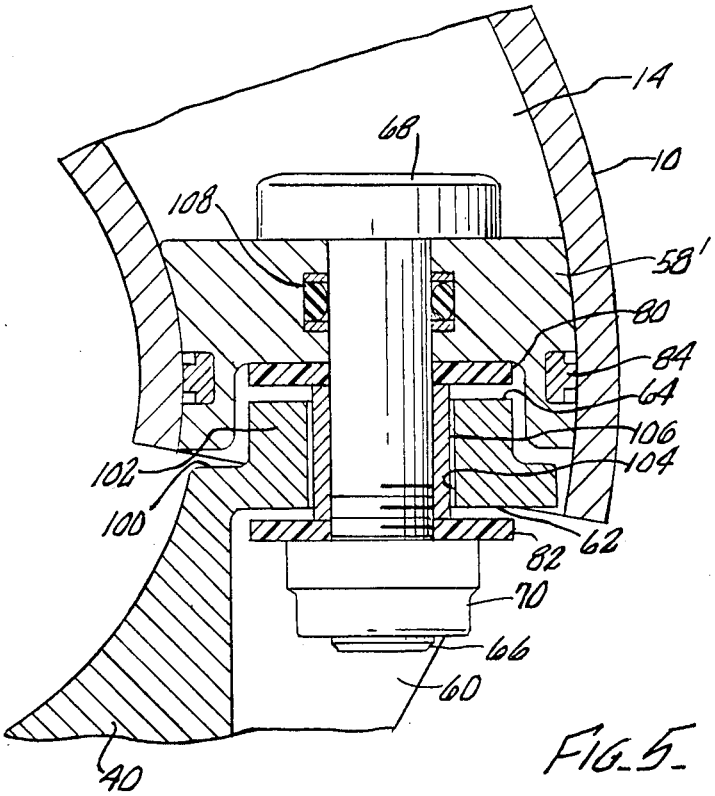
FIG. 5 is a view in isolation of an alternative embodiment of the piston head of the actuator and of an alternative embodiment of the manner in which the piston head is attached to the piston arm.
Figure 6:
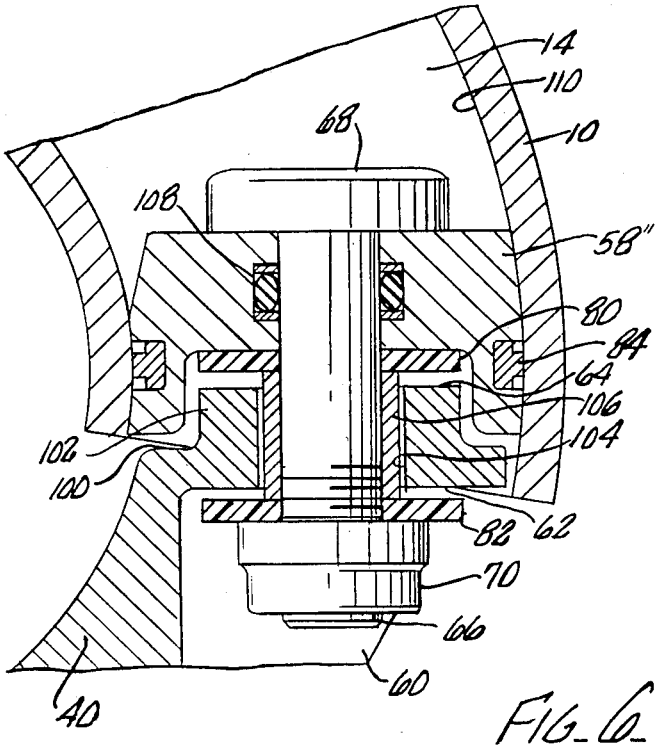
FIG. 6 is a view in isolation of an alternative embodiment of the piston head.

Another method of attachment of the piston head 58 to the piston arm 40 is shown in FIGS. 5 and 6. Here, the piston head 58' and 58" does not have an interior cavity. Rather, the piston head has a centrally located aperture through which bolt 66 is inserted. Another modification is made to face 64 of piston arm 40. The end of piston arm 40 is reduced in size to create a shoulder 100 and a neck portion 102. The piston head 58' and 58" has a small cavity which fits over the neck portion 102. To provide for movement of the piston head 58' and 58" relative to the piston arm in this arrangement, the aperture 104 between face 64 and shoulder 62 is made appreciably larger than the size of bolt 66. A spacer 106 extends between nut 70 and the underside of the piston head 58' and 58" to allow for pretensioning of the bolt 66. This pretensioning of the bolt 66 increases its fatigue life, and also permits precise looseness between the piston head 58' and 58" and the piston arm 40. In this embodiment, the thrust washers 80 and 82 are placed between the piston head 58' and 58" and face 64 and between shoulder 62 and nut 70. It will also be understood that because the aperture in the piston head is now exposed to pressure, packing and retainer ring 108 must be utilized.

FIGS. 5 and 6 also display alternative embodiments for the configuration of the piston head. Looking first to FIG. 5, piston head 58' is in the shape of a toroid segment so that the sealing contact between the piston head 58' and the walls of second chamber 14 is increased. This configuration finds its greatest utility in those applications where extremely high pressures are experienced. Although this configuration of piston head 58' presents a potential for greater friction between the piston head the walls of second chamber 14, the precision with which the toroidal bore of second chamber 14 is machined, and the provision for low friction float of the piston head 58' during movement of the piston arm 40, minimizes the increased frictional problems.

In FIG. 6, another embodiment of piston head 58" is shown. Here, the exterior piston surface is generated by a radius equal to that of the interior surface 110 of the exterior wall of second chamber 14.

Although specific embodiments of the inventive concepts hereinafter claimed have been depicted in the figures and hereinabove described, it will be apparent to those skilled in the art that many modifications to those embodiments are possible without departing from the inventive concepts hereinafter claimed. Accordingly, this patent and the protection it provides are not limited to these few specific embodiments, but is of the full breath and scope of the appended claims.

In the claims:

1. A single piston, double acting rotary actuator comprising a housing having a closed first end and an open second end, said housing defining a cylindrical hollow space except for an annular chamber in the shape of an arc segment of a toroid in said housing against said closed end, said annular chamber opening into said hollow space in said housing; a centrally located aperture in said closed first end of said housing; a drive shaft rotatably attached to said housing and extending exteriorly of said housing through said aperture in said closed end; an annular piston arm attached to said drive shaft, such that the distal end of said piston arm rotates in said housing coaxially with and in said annular chamber; piston head means attached to said piston arm for providing sealing contact with said annular chamber during the movement of said piston arm therein; cap means for closing said second end of said housing; port means for introducing fluid pressure into said annular chamber and into said hollow space in said housing such that said piston head means can be moved in either direction in said annular chamber; and attachment means for attaching said piston head means to said piston arm such that said piston head means may move laterally relative to said piston arm and such that said piston head means can move axially relative to said piston arm between first and second positions in response to fluid pressures in said annular chamber; and friction reduction means to be engaged in both the first position and the second position to reduce friction when said piston head means laterally relative to said piston arm.

2. The invention of claim 1 wherein said friction reduction means comprises at least one thrust washer.

3. The invention of claim 2 wherein said thrust washer has a coating of friction reduction material.

4. The invention of claim 3 wherein said friction reduction coating contains polytetrafluoroethylene.

5. The invention of claim 1 wherein said attachment means comprises (a) bolt means attached to and extending longitudionally from said piston arm, said bolt having an enlarged portion at its end distal from said piston arm;

(b) an interior cavity defining the width space in said piston head means, said interior cavity being of a size substantially greater than said enlarged portion of said bolt means; and (c) insert means attached to said piston heat means for attaching said piston head to said bolt means, said insert means having an aperturing through which said bolt means passes, said aperture being appreciably larger than the diameter of said bolt means.

6. The invention of claim 5 wherein said friction reduction means are placed between said insert means and said enlarged portion of said bolt means, and between said insert means and said piston arm.

7. The invention of claim 1 wherein said attachment means comprises (a) an aperture in said piston arm; (b) bolt means extending through said aperture, said bolt means having a diameter appreciably less than said aperture;

(c) an aperture in said piston head means through which said bolt means extend, said piston head aperture being equal in size to said bolt means;

(d) nut means for securing said bolt to said piston arm; and (e) spacer means between said piston head means and said nut means.

8. The invention of claim 7 wherein said friction reduction means are placed between said piston head means and said piston arm, and between said piston arm and said nut means.

9. The invention of claim 1 wherein said piston head has a convex radial exterior configuration, an exterior circumferential groove formed at the point of the piston head means maximum exterior diameter, and sealing means in said grooves for sealing against fluid bypass in said annular chamber.

10. The invention of claim 1 wherein said piston head means has an exterior surface configuration of a toroid segment.

11. In a rotary actuator having a housing, an annular chamber in said housing, an annular piston arm attached to said housing and rotatable through an arc coaxially within said annular chamber, and a piston head attached by attachment means to said piston arm, said attachment means for allowing lateral movement of said piston head relative to said piston arm, the improvement in said attachment means comprising: means to permit said piston head to move axially relative to said piston arm between first and second positions in response to a fluid pressure in said annular chamber; and the improvement further comprising: friction reduction means to be engaged in both the first position and the second position to reduce friction when said piston head moves laterally relative to said piston arm.

12. The invention of claim 11 wherein said friction reduction means comprises at least one thrust washer having a coating of friction reduction material.

13. The invention of claim 12 wherein said coating contains polytetrafluoroethylene.

14. In a double acting, fluid driven rotary actuator having a housing and an annular chamber within said housing, the improvement comprising a single piston arm and attached piston head rotatable in either direction coaxially within said annular chamber, means for introducing a fluid pressure fore and aft of said piston head, and attachment means for attaching said piston head to said piston arm such that said piston head can move laterally relative to said piston arm and such that said piston head can move axially relative to said piston arm between first and second positions in response to said fluid pressure; and friction reduction means to be engaged in both the first position and the second position to reduce friction when said piston head moves laterally relative to said piston arm.

* * * * *